US006478250B1

(12) United States Patent
Adams et al.

(10) Patent No.: US 6,478,250 B1
(45) Date of Patent: Nov. 12, 2002

(54) PROPULSIVE TORQUE MOTOR

(75) Inventors: Robert J. Adams, Tucson, AZ (US); Michael B. McFarland, Tucson, AZ (US); Wayne V. Spate, Tucson, AZ (US); Arthur J. Schneider, Tucson, AZ (US); Michael J. Kaiserman, Tucson, AZ (US); Stanton L. Winetrobe, Oro Valley, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/659,147

(22) Filed: Sep. 11, 2000

Related U.S. Application Data

(60) Provisional application No. 60/158,790, filed on Oct. 12, 1999.

(51) Int. Cl.[7] ..... F42B 15/14

(52) U.S. Cl. ..... 244/3.23; 244/3.22; 60/201

(58) Field of Search ..... 244/3.22, 3.23, 244/73 R; 60/231, 228, 271, 201; 239/265.17

(56) References Cited

U.S. PATENT DOCUMENTS 33,746 A * 11/1861 Matteson
3,107,488 A * 10/1963 Strauss et al.
3,166,897 A * 1/1965 Lawrence et al.
3,200,586 A 8/1965 Ernest
3,540,679 A * 11/1970 McCullough
3,754,725 A * 8/1973 Kartzmark et al.
3,995,558 A * 12/1976 Travor et al.
4,007,586 A 2/1977 McDermott
4,497,460 A 2/1985 Thorsted et al.
4,674,707 A * 6/1987 Kranz
4,726,544 A * 2/1988 Unterstein
4,745,861 A 5/1988 Fenton et al.
5,005,781 A 4/1991 Baysinger et al.
5,016,835 A * 5/1991 Kranz
5,078,336 A 1/1992 Carter
5,662,290 A 9/1997 Voigt

* cited by examiner

*Primary Examiner*—Charles T. Jordan
*Assistant Examiner*—T. Dinh
(74) *Attorney, Agent, or Firm*—Renner, Otto, Boisselle & Sklar, LLP

(57) ABSTRACT

A spin-stabilized missile includes two or more spin nozzles along a perimeter of the missile, the nozzles being operatively coupled to a pressurized gas source. The pressurized gas source provides pressurized gas which passes through the nozzles and external to the missile, thereby providing circumferential thrust which causes a torque on the missile that results in the missile rolling or spinning. The pressurized gas source may be a pressure container containing solid rocket fuel. The pressurized gas source for spinning the missile may be the same as that for the missile's main propulsion system.

15 Claims, 5 Drawing Sheets

PROPULSIVE TORQUE MOTOR

This application claims the benefit of U.S. Provisional Application No. 60/158,790, filed Oct. 12, 1999.

BACKGROUND OF THE INVENTION

1. Technical Field of the Invention

The invention relates to spin-stabilized missiles and methods for spinning missiles to stabilize them. Particularly, the invention relates to missiles and methods utilizing thrust to impart spin or roll.

2. Description of the Prior Art

One problem in accurately targeting missiles is the possibility of thrust misalignments relative to the missile center line. Such misalignments may result in undesirable trajectory excursions during the boost phase when the rocket is firing. One way of maintaining desired accuracy, particularly when engaging targets at minimum range, is by rolling or spinning the missile so that the misaligned thrust does not dwell for an excessive amount of time in any one roll quadrant. The roll rates required to avoid unacceptable deviations in trajectory can be significant. In an exemplary simulation, a thrust misalignment of 0.1° was found to create unacceptable flight path deviations with missile roll rates of less than 15 Hertz.

One method of imparting a spin or roll rate to a missile has been through use of aerodynamic forces generated by canted fins on the missile. One serious shortcoming of this approach stems from the fact that the torque applied by the fins is a function of the forward velocity of the missile. Upon launch, missile velocity is low, resulting in correspondingly low aerodynamic stability of the missile. This immediate post-launch period is therefore the time when the missile is most affected by thrust misalignments. Conversely, the magnitude with which the thrust misalignment acts on the air frame is a function of the thrust profile and nozzle asymmetry. The thrust misalignment is nearly independent of missile velocity. By virtue of the low launch velocity, aerodynamic rolling forces generated by canted fins start out very low and increase as the missile builds speed. This results in a very low roll rate early in the flight when the missile is most susceptible to thrust misalignment. The spin or roll rate increases as the missile goes down range, but the minimum required roll rate may not be achieved until the missile has flown a considerable distance and has suffered a considerable deviation from the desired trajectory.

Another method of imparting a roll rate to a missile has been to utilize spiral grooves in the launch tube, much like rifling is used to impart spin to a bullet as it travels the length of a gun barrel. This technique has the potential for imparting a substantial roll rate at low velocity. However, it has the disadvantage that it may apply high mechanical drag forces to the missile as it moves through the launcher.

Yet another method of imparting spin to a missile has been to employ turning vanes to the main rocket motor nozzle as a means of imparting rolling torque to the missile air frame. This method may impart substantial roll rates at low velocities. Nevertheless, it adds undesirable weight, complexity, and cost to the nozzle design. It also may reduce nozzle efficiency. Furthermore, it may contribute to thrust misalignment due to asymmetric erosion of the turning vanes.

From the foregoing it may be seen that a need exists for spin-stabilized missiles and methods for imparting spin to missiles that avoid the disadvantages of the prior methods.

SUMMARY OF THE INVENTION

A spin-stabilized missile includes two or more spin nozzles along a perimeter of the missile, the nozzles being operatively coupled to a pressurized gas source. The pressurized gas source provides pressurized gas which passes through the nozzles and external to the missile, thereby providing circumferential thrust which causes a torque on the missile that results in the missile rolling or spinning. The pressurized gas source may be a pressure container containing solid rocket fuel. The pressurized gas source for spinning the missile may be the same as that for the missile's main propulsion system.

According to an aspect of the invention, a missile includes nozzles tangentially mounted on a missile surface, the nozzles used to spin or roll the missile.

According to yet another aspect of the invention, a missile includes nozzles mounted flush along a perimeter of the missile, the nozzles used to impart a spin or roll to the missile.

According to still another aspect of the invention, a missile includes a separable external spin motor for imparting spin or roll to a missile during the initial part of its flight. The spin motor is then jettisoned from the missile.

According to a further aspect of the invention, a missile includes a spin propulsion system in a middle or forward part of the missile.

According to a still further aspect of the invention, a missile includes a casing, a main propulsion system at least partially within the casing, and a spin propulsion system including nozzles operationally configured to expel a pressurized gas to produce a spinning torque on the missile, wherein the nozzles are forward of the main propulsion system.

According to another aspect of the invention, a missile includes a casing having one or more openings therethrough and a spin propulsion system which includes nozzles coupled to the openings, wherein the nozzles are operationally configured to expel a pressurized gas from a pressurized gas source therethrough, thereby producing a spinning torque on the missile.

According to yet another aspect of the invention, a method of spinning a missile during flight includes providing thrust in longitudinal direction using a main propulsion system, and providing thrust in a circumferential direction by expelling pressurized gas from the missile in a substantially circumferential direction.

According to still another aspect of the invention, a method of spinning a missile includes expelling pressurized gas from a nose-mounted spin motor section, and jettisoning the spin motor section.

According to a further aspect of the invention, a method of spinning a missile includes initiating, after the missile completely leaves a launcher, expelling pressurized gas to spin the missile.

According to a still further aspect of the invention, a method of spinning a missile includes initiating expelling pressurized gas to spin the missile, after initiation of a main propulsion system and before the missile completely leaves the launcher.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

Figures 1, 2:
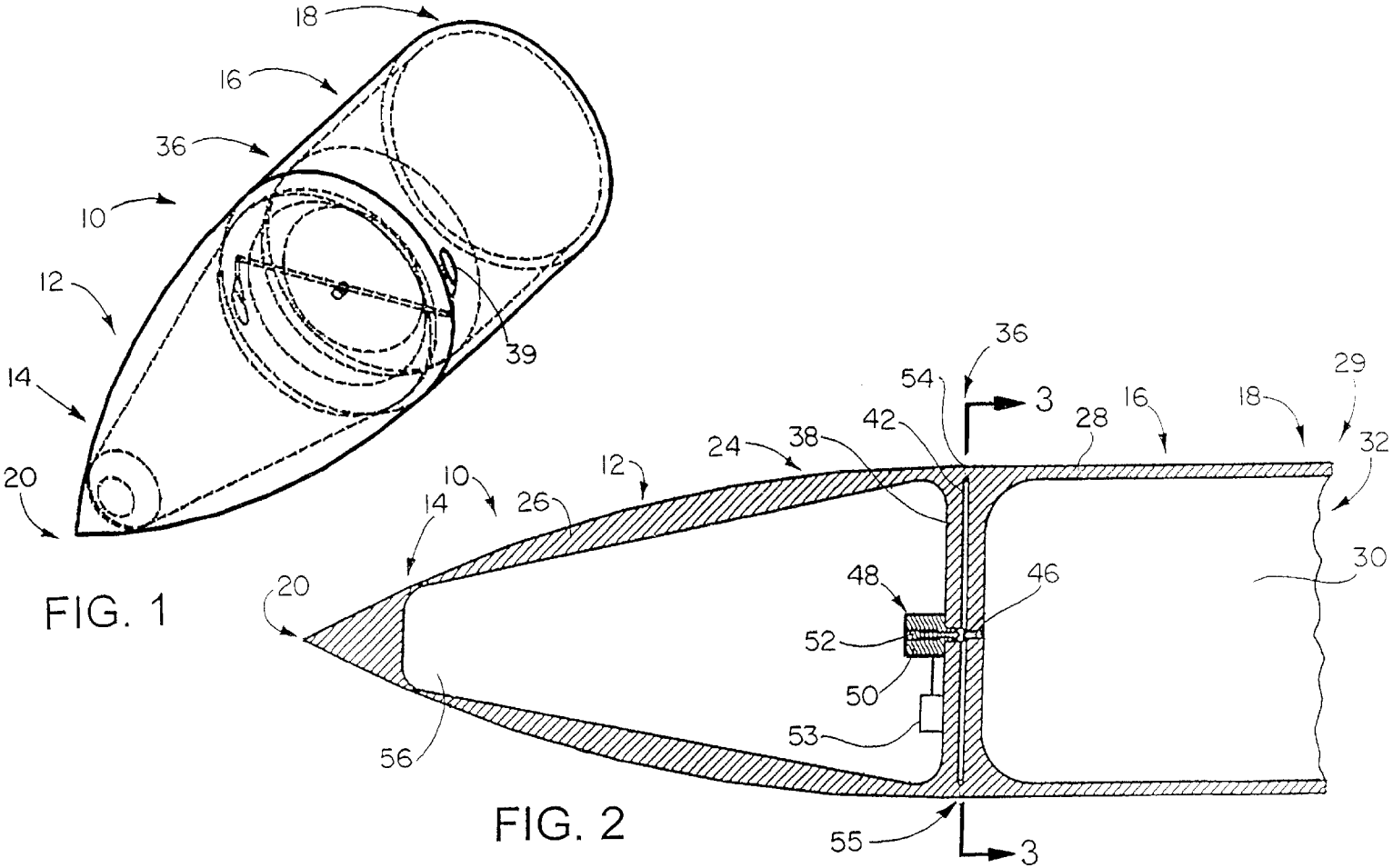
FIG. 1 is a perspective view of part of a missile in accordance with the present invention.
FIG. 2 is a side sectional view of the part of the missile of FIG. 1.

Referring now to the figures and initially to FIGS. 1 and 2, a part of a missile 10 of the present invention is shown. The missile 10 has a nose section 12 at a nose end 14, and has a tail section 16 at a tail end 18, only part of the tail section 16 being shown. The nose section is tapered, having a tip 20 at the nose end 14 and gradually increasing in diameter away from the tip, thereby having a generally conical shape. The shape of the nose section 12 continuously merges with the shape of the tail section 16, the tail section being substantially cylindrical. The inner parts of the missile 10 are enclosed by a projectile body or casing 24 which has a nose body portion 26 and a tail body portion 28.

The tail section 16 includes a main propulsion system 29 which provides thrust to propel the missile 10 forward. An exemplary main propulsion system is a rocket motor. Such a motor includes a chemically-reactive propellant such as a rocket propellant 30 in a tail chamber 32 enclosed by the tail body portion 28. The rocket propellant 30 may be, for instance, solid rocket fuel. As the rocket propellant burns, hot gases are produced. The hot gases exit the missile 10 through an aft nozzle or nozzles (not shown), thereby providing missile thrust in a forward, longitudinal direction. It will be appreciated that many such suitable propulsion systems for propelling a missile are well-known in the art, and further detail of such systems is omitted here for the sake of brevity.

It will be appreciated that propellants may be employed in addition to or in place of the solid fuel rocket motor described above. For example, a liquid fuel rocket motor may be used.

The missile 10 includes a spin propulsion system 36 to provide thrust in a circumferential direction in order to spin or roll the missile. The spin propulsion system 36 includes a manifold 38 (FIG. 3) which has openings 39 in the casing 24 coupled to nozzles 40 for expelling pressurized gas external to the missile in a circumferential direction, i.e. perpendicular to the longitudinal axis oriented fore and aft along the length of the missile. The nozzles 40 are in communication with the tail chamber 32 via a channel 42 extending diametrically across the manifold 38 and linking the nozzles 40, and via a bleed off port 46 putting the channel 42 in communication with the tail chamber 32. As hot gases are produced by the burning of the propellant 30 in the tail chamber 32, some of the pressurized hot gas enters off the bleed off port 46 and proceeds through the channel 42 to be expelled from the missile 10 through the nozzles 40. As the gases are expelled through the nozzles 40 the missile 10 experiences a torque due to the circumferential thrust which turns it along its longitudinal axis.

Figure 4:
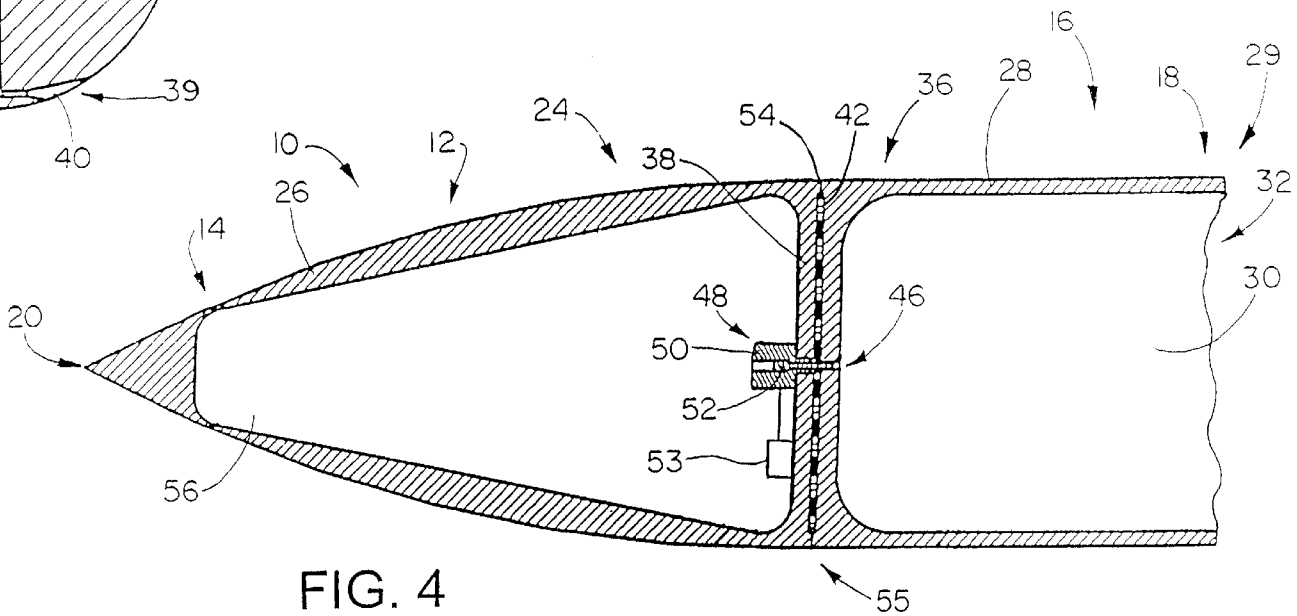
FIG. 4 is a side sectional view of the part of the missile of FIG. 1 with its bleed valve closed.

The spin propulsion system 36 also includes a bleed valve 48 for selectively opening and closing the bleed off port 46. The bleed valve 48 is attached or otherwise coupled to the manifold 38. The bleed valve 48 includes a stationary valve body 50 and a movable valve member 52, the valve member 52 being slidable within the valve body 50. As shown in FIG. 2, the bleed valve 48 may be open, with the valve member 52 retracted into the valve body 50, thereby allowing flow of pressurized gases through the bleed off port 46 for eventually being expelled through the nozzle 40. Alternatively, as shown in FIG. 4, the bleed valve 48 may be closed, with the valve member 52 extended to prevent flow through the bleed off port 46.

By controlling flow of pressurized gases to the nozzles 40 that provide circumferential thrust, the timing and amount of missile spin may be controlled. For example, the missile 10 may be launched from a launch tube or other launcher. Effectiveness of the nozzles 40 in providing circumferential thrust may be reduced when the nozzles are still within the launcher. Therefore it may be desirable to delay application of circumferential thrust until after the nozzles 40 have cleared the launcher. This delay may be accomplished by employing a controller 53 which includes a timing delay device which is operatively coupled to and which delays opening of the bleed valve 48 until a specified time after ignition of the main propulsion system 29, the specified time being selected so as to allow the missile 10 to move sufficiently for the nozzles 40 to clear the launcher.

Spinning while the missile is in the launcher may also produce additional drag on the missile, which is undesirable. Therefore, the timing for opening the bleed valve 48 and applying circumferential thrust may be selected such that all or substantially all of the missile has cleared the launcher prior to application of the circumferential thrust.

The timing delay device may be a timing delay circuit which electronically controls the delay between ignition of the main propulsion system and opening of the bleed valve 48. The controller 53 may be dedicated to controlling the bleed valve 48 or alternatively may also control ignition of the main propulsion system 29.

It will be appreciated that many alternate methods and systems may be employed to achieve the time delay. For example, the timing delay device may employ a pyrotechnic device which is ignited at the same time as the main propulsion system and which delays opening of the bleed valve for a specified time. The timing sequence of the timing delay device may be activated by a direct connection to the means for igniting the main propulsion system 29, or alternatively may be activated by sensing acceleration of the missile due to firing of the main propulsion system, for example. Alternatively the bleed valve may be pressure activated, opening when a desired pressure in the tail chamber 32 is reached.

It will further be appreciated that the timing delay device 53 may be mounted close to or remotely from the bleed valve 48.

The bleed valve 48 may also be used to shut off circumferential thrust after a desired spin rate has been achieved. For example, an electronic timing circuit which is part of the timing delay device 53 may be used to close the bleed valve after a desired torque impulse has been applied to the missile. The time for application of the torque impulse may be determined from the flow rate and velocity of gases exiting the nozzles 40, from the weight of the missile, and from other dimensions and characteristics of the missile. It will be appreciated that a pyrotechnic device may alternatively be employed to shut off the circumferential thrust after a specified period of firing time.

Alternatively, closing of the bleed valve 48 may be effected when a desired spin rate has been achieved, by use of a centrifugal sensor which senses rotation of the missile and sends a signal to close the bleed valve or otherwise effects closure of the bleed valve when the desired rotational rate has been achieved. Such a centrifugal sensor may be incorporated as part of the timing delay device.

It will be appreciated that the valve member may be moved within the valve body by any of many well-known, suitable mechanisms for causing such movement. For example, the bleed valve may be a solenoid valve, with the position of the valve member being controlled by selectively applying electricity to a solenoid in the valve body. Alternatively the bleed valve may be driven by pressurized fluid for positioning of the valve member. It will be appreciated that it may be possible to use the pressurized gases from the tail chamber to effect or aid movement of the valve member. It will be appreciated that other means may be used to accomplish movement of the valve member within the valve body of the bleed valve including various suitable electronic and electromechanical means.

Figure 3:
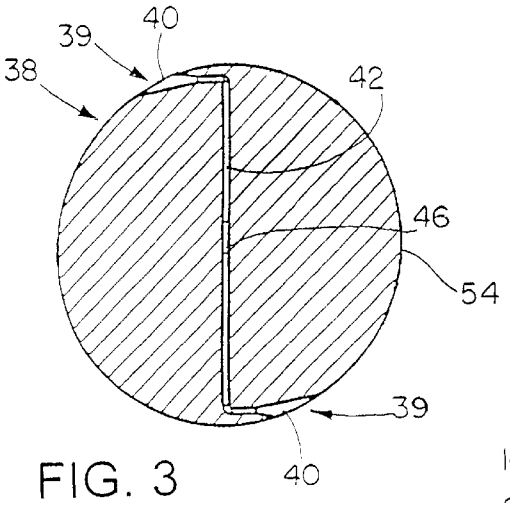
FIG. 3 is a sectional view along section 3—3 of FIG. 2.

As shown in FIG. 3, the nozzles 40 are internal, being internally mounted to the projectile body or casing 24, with their output ports flush with an outer surface of the missile 10. It will be appreciated that such internal nozzles have the advantage of producing less drag on the missile when compared with nozzles that are external to the projectile body 24 of the missile 10. However, it will be appreciated that externally-mounted nozzles may alternatively be used if desired.

The spin propulsion system 36 is located where the nose section 12 and the tail section 16 meet. This location is desirable because it represents the forward-most location on the projectile body 24 where the missile diameter is at its maximum. A larger diameter results in greater torque for a given amount of circumferential thrust. Thus it is desirable for the nozzles 40 to be located along a perimeter 54 of the projectile body 24. Moreover, it is desirable for the nozzles 40 to be located where the diameter of the projectile body is at or near its maximum value, such as at a forward end 55 of the tail body portion 28.

Further, it is desirable for the nozzles to be located closer to the tip 20 of the missile so that they clear the launcher earlier. As noted above, it may be desirable to delay application of the circumferential thrust until after the nozzles have cleared the launcher. By placing the nozzles forward on the missile, this delay is reduced, thus allowing the missile to reach its desired spin rate earlier, thereby increasing accuracy of the missile. However, it will be appreciated that the nozzles may be located at a different longitudinal location on the missile if desired.

The missile has a nose chamber 56 in its nose section 12. The nose chamber 56 may be used for carrying a payload such as a chemical energy warhead. It will be appreciated that the bleed valve 48 may be located off the centerline of the missile, allowing the incorporation of alternative payloads such as heavy metal kinetic energy penetrators. In addition or in the alternative, it will be appreciated that the nose chamber 56 may be used to carry additional propellant, with the nose chamber 56 and the tail chamber 32 being in communication with one another to allow pressurized gases from the nose chamber 56 to enter the tail chamber 32 for use in the main propulsion system and/or the spin propulsion system.

It will be appreciated that the number of nozzles for applying circumferential thrust may be greater than that shown. Preferably the nozzles are evenly spaced about a circumferential perimeter of the missile, so as to avoid undesirable uneven forces on the missile.

The nozzles are preferably oriented substantially tangential to the projectile body 24 in a plane that is substantially perpendicular to a longitudinal axis of the missile 10, thereby providing a maximum amount of torque for a given thrust from the nozzles. However, it will be appreciated that the nozzles may be otherwise oriented if desired. For example, the nozzles may be oriented partially aftward, thereby providing forward thrust on the missile as well as circumferential thrust.

What follows now are alternate embodiments of the invention. The details of certain common features between the alternate embodiments and the embodiment described above are omitted in the description of the alternate embodiments for the sake of brevity. It will be appreciated that features of the various alternate embodiments may be combined with one another and may be combined with features of the embodiment described above.

Figure 5:
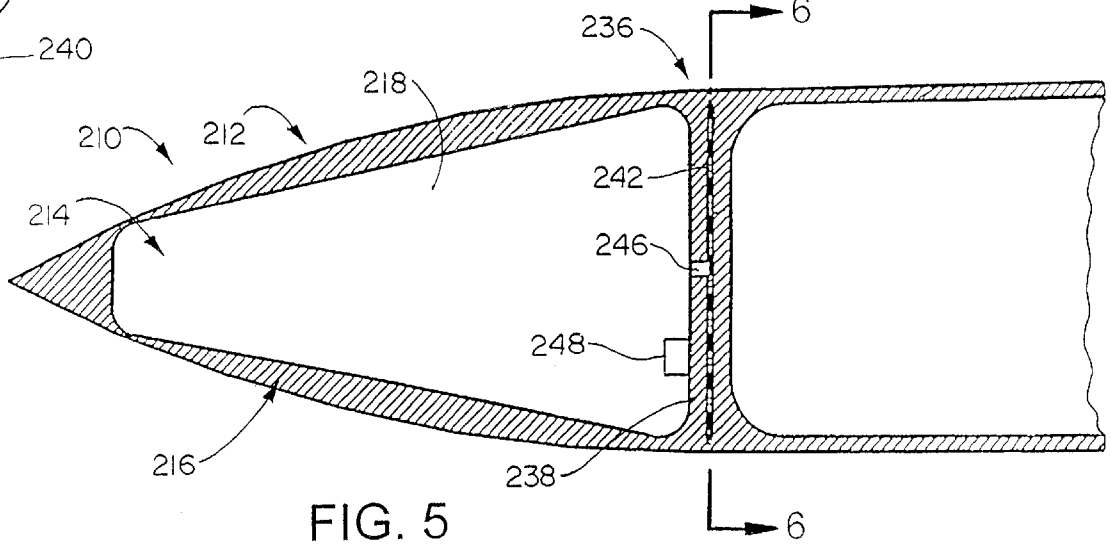
FIG. 5 is a side sectional view of part of an alternate embodiment missile in accordance with the present invention.
Figure 6:
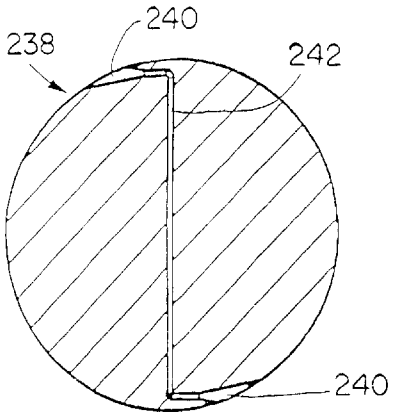
FIG. 6 is a sectional view along section 6—6 of FIG. 5.

Referring to FIGS. 5 and 6, a missile 210 is shown which has a separate pressurized gas source for spinning the missile. A nose section 212 of the missile includes a nose chamber 214. A pressurized gas source 216 includes the nose chamber 214 filled with a pressurized gas or having a material therein which produces a pressurized gas, an example of such material being a chemically-reactive propellant such as solid rocket fuel 218. The gas source 216 is operationally coupled to a spin propulsion system 236 which includes a manifold 238. The manifold 238 includes nozzles 240, as well as a channel 242 and a port 246 to bring the nozzles 240 into communication with the nose chamber 214.

It will be appreciated that depending on the source of pressurized gas, for example the type and shape of a chemically reactive propellant, the nose chamber 214 may be brought into communication with the nozzles 240 directly, without need of a port 246 and/or a channel 242 and/or a manifold 238.

Upon ignition of the rocket fuel 218, pressurized gases are created in the nose chamber 214. It will be appreciated that depending on the source of pressurized gas, for example the type and shape of a chemically reactive propellant, the nose chamber 214 may be brought into communication with the nozzles 240 directly, without need of a port 246 and/or a channel 242 and/or a manifold 238. These gases flow through the port 246 in the channel 242, and thereafter exit the missile 210 through the nozzle 240. Thereby circumferential thrust is provided which causes a torque which spins the missile 210.

The rotational thrust impulse used to spin the missile may be controlled by the type and/or amount of propellant in the nose chamber 214. That is, the type and amount of propellant may be selected so as to provide the desired impulse to spin the missile at the desired rate. The timing of the supply of pressurized gas to the nozzles 240 may be controlled by, for example, use of a timing circuit 248 to properly time ignition of the rocket fuel 218 relative to ignition of the main propulsion system.

It will be appreciated that control of the supply of propellant to the nozzles 240 may alternatively or in addition be accomplished by use of a valve, similar to the use of the bleed valve 48 described above.

It will further be appreciated that the pressurized gas source may alternatively employ one or more of a large variety of suitable reactive and non-reactive propellants.

Figure 9:
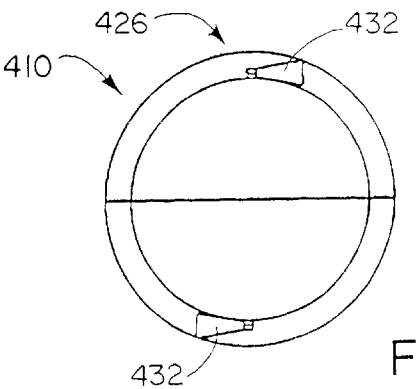
FIG. 9 is an end view of the forward end of the missile of FIG. 7.
Figure 8:
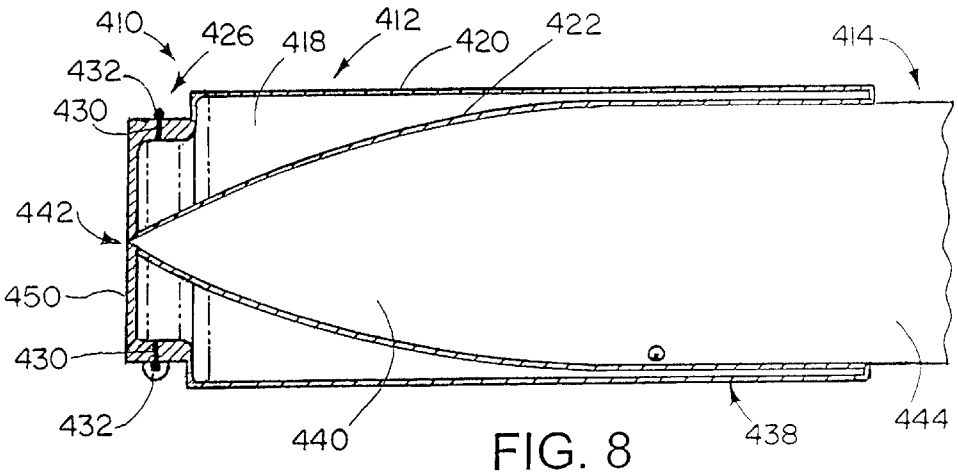
FIG. 8 is a side sectional view of the part of the missile of FIG. 7.
Figure 7:
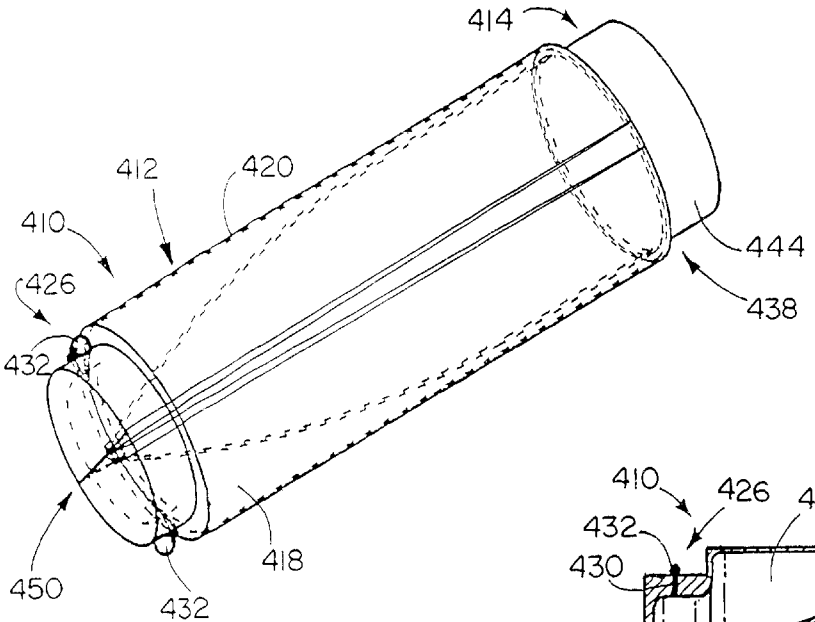
FIG. 7 is a perspective view of part of another alternate embodiment missile in accordance with the present invention.

Turning now to FIGS. 7–9, an alternate embodiment missile 410 is shown which has an external spin motor 412 mounted on and separable from a projectile 414. The spin motor 412 has a chamber 418 defined and enclosed by an external chamber wall 420, an internal chamber wall 422, and a cap 426.

The chamber 418 contains a propellant such as solid rocket fuel. The cap 426 has passages 430 therethrough, the passages 430 allowing communication between the chamber 418 and external nozzles 432 attached to the outside of the cap. The nozzles 432 are oriented so as to provide circumferential thrust for spinning the missile 410. Preferably, the nozzles 432 are in a plane that is substantially perpendicular to a longitudinal axis of the missile 410. The cap 426 and the nozzles 432 are sized such that the nozzles do not protrude radially beyond the diameter of the other parts of the external spin motor 412. It will be appreciated that the cap may alternatively have a larger diameter with internally mounted nozzles similar to the nozzles described above with regard to the missiles 10 and 210.

The projectile 414 has a projectile body or casing 438 as its outer surface. The projectile body 438 includes a tapered nose body portion 440 culminating in a tip 442, and a substantially cylindrical tail body portion 444. The internal chamber wall 422 is shaped so as to conform to the shape of the projectile body 438.

The external spin motor 412 is designed to separate from the projectile 414 after the propellant within the chamber 418 is consumed. The separation may be accomplished by any of a variety of well-known methods. For example, the external spin motor 412 may be made of two or more sections which are held together on the projectile body 438 by a band. During flight the band may be severed at a desired time, for example by use of a suitable pyrotechnic device, thereby causing the sections of the external spin motor to separate from the projectile body.

The nozzles 432 of the missile 410 are located in the forwardmost part of the missile, at the end of the missile 410 nearest the tip 442. Thus when the missile 410 leaves its launcher, the nozzles 432 are among the first parts of the missile to exit the launcher. This may allow earlier actuation of the spin motor when compared with missiles having nozzles in their middles or in their tail sections. By utilizing the separable external spin motor 412, the nozzles 432 may be at the forwardmost part of the motor and at a diameter approximately that of the rest of the missile. Such a configuration is practical because the external motor separates early in the flight of the missile 410. This allows the forwardmost part of the external spin motor 412 to have a non-streamlined shape, which otherwise might result in unacceptable drag or aerodynamic instability if the spin motor was to remain attached to the. missile for the entire flight. Thus the cap 426 may have a flat front face 450.

The above embodiments, therefore, all involve utilizing pressurized gas from a pressurized gas source, which is expelled through nozzles along a perimeter of the missile, to provide thrust in a circumferential direction. The circumferential thrust causes a torque on the missile which imparts roll or spin to the missile. The spin can be achieved rapidly when compared with methods such as the use of fins which utilize aerodynamic forces to impart spin to a missile. In addition, it will be appreciated that circumferential thrust can be employed to spin a missile regardless of atmospheric conditions or even the lack of an atmosphere.

The above embodiments may be particularly beneficially employed in missiles having heavy or high density payloads.

In an exemplary embodiment a missile having a six-inch diameter reaches a roll rate of approximately 25 Hertz in 0.035 seconds. The time delay between firing the main thruster and initiating the thrust through the circumferential thrusters is 0.005 seconds. It will be appreciated the above values are only exemplary, and that many variations are possible.

Figure 10:
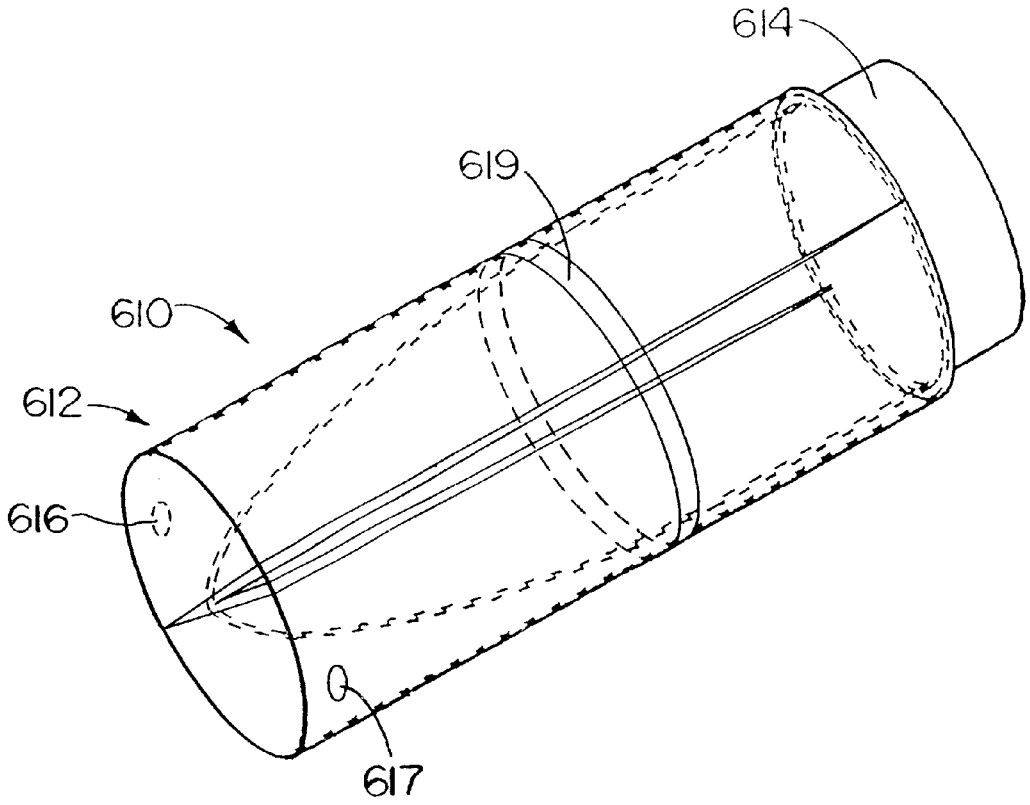
FIG. 10 is a perspective view of part of yet another alternate embodiment missile in accordance with the present invention.

FIG. 10 shows a missile 610 that is an alternate embodiment of the missile 410 described above. The missile 610 includes an external spin motor 612 that is mounted on and separable from a projectile 614. The external spin motor 612 has internally located nozzles 616 and 617, as discussed above with regard to the missile 410. The external spin motor 612 is in two or more sections, which are held together by a band 619, as discussed above with regard to the missile 410.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A missile comprising:

a main propulsion system at least partially within the casing;

a spin propulsion system which includes nozzles operationally configured to expel a pressurized gas to produce a spinning torque on the missile; and a pressurized gas source which provides the pressurized gas to the nozzles;

wherein the nozzles are forward of the main propulsion system;

wherein the spin propulsion system is an external spin motor section externally mounted on the casing, the spin motor section including the pressurized gas source and the nozzles;

wherein the nozzles are located on along a front plane of the spin propulsion system; and wherein the nozzles are located about a longitudinal axis of the missile at substantially the same location along the axis as a tip of the missile.

2. The missile of claim 1, wherein the casing has a tail portion and a nose end opposite the tail portion, and wherein the spin motor section is mounted on the nose end.

3. The missile of claim 1, wherein the spin motor section has a chamber defined between an internal wall and an external wall, the internal wall conforming in shape to at least a part of the casing, and wherein the gas source is in communication with the nozzles via openings in the casing, and the chamber.

4. The missile of claim 1, wherein the spin motor section is operatively configured to separate from the casing while the missile is in flight.

5. A missile comprising:

a main propulsion system at least partially within the casing;

a spin propulsion system which includes nozzles operationally configured to expel a pressurized gas to produce a spinning torque on the missile; and a pressurized gas source which provides the pressurized gas to the nozzles;

wherein the nozzles are forward of the main propulsion system;

wherein the spin propulsion system is an external spin motor section externally mounted on the casing, the spin motor section including the pressurized gas source and the nozzles;

wherein the casing has a tail portion and a nose end opposite the tail portion;

wherein the spin motor section is mounted on the nose end;

wherein the spin motor section includes a cap to which the nozzles are externally mounted, the cap encircling the nose end when the spin motor section is mounted on the casing; and wherein the cap has a non-streamlined shape.

6. A method of spinning a missile during flight, comprising:

providing thrust in longitudinal direction using a main propulsion system; and providing thrust in a circumferential direction by expelling pressurized gas from the missile in a substantially circumferential direction;

wherein the missile is launched from a launcher; and wherein the expelling pressurized gas is initiated after initiation of the main propulsion system and before the missile completely leaves the launcher.

7. The method of claim 6, wherein the expelling pressurized gas includes expelling pressurized gas through nozzles along a circumference of the missile and wherein the expelling pressurized gas is initiated after the nozzles clear the launcher.

8. The method of claim 6, wherein the expelling pressurized gas includes expelling the pressurized gas through openings in a missile casing.

9. The method of claim 6, wherein the expelling pressurized gas includes expelling pressurized gas from a spin motor section externally mounted on a nose end of a projectile body of the missile.

10. The method of claim 9, further comprising jettisoning the spin motor section after the expelling pressurized gas.

11. The method of claim 10, wherein the jettisoning includes severing a band that holds together parts of the spin motor section.

12. The method of claim 6, further comprising supplying the pressurized gas from a gas source that utilizes a chemically-reactive propellant to produce the pressurized gas.

13. A missile comprising:

a casing that has a tail portion and a nose end opposite the tail portion;

a main propulsion system at least partially within the casing; and an external spin motor section externally mounted on the nose end of the casing, the spin motor section including:

nozzles operationally configured to expel a pressurized gas to produce a spinning torque on the missile;

a cap to which the nozzles are externally mounted, wherein the cap encircles the nose end when the spin motor section is mounted on the casing, and wherein the cap has a flat front surface; and a pressurized gas source which provides the pressurized gas to the nozzles.

14. The missile of claim 13, wherein the cap has a stepped front end, with an annular surface substantially parallel to the flat front surface.

15. The missile of claim 14, wherein the nozzles are aft of the flat front surface and forward of the annular surface.

* * * * *